United States Patent [19]

Larsen

[11] Patent Number: 5,033,121

[45] Date of Patent: Jul. 23, 1991

[54] COMBINED CLOTHING ARTICLE

[76] Inventor: Douglas S. Larsen, 255 E. 800 South, Layton, Utah 84041

[21] Appl. No.: 539,022

[22] Filed: Jun. 15, 1990

[51] Int. Cl.[5] ..... A41D 1/00

[52] U.S. Cl. ..... 2/229; 2/78 A; 2/78 B; 2/78 C; 2/107; 2/77; 2/80; 2/113; 2/115

[58] Field of Search ..... 2/229, 78 A, 78 B, 78 C, 2/106, 107, 112, 77, 80, 113, 115

[56] References Cited

U.S. PATENT DOCUMENTS

| | | | |
|---|---|---|---|
| 1,168,191 | 1/1916 | Gerhardt | 2/77 |
| 1,249,108 | 12/1917 | Jones | 2/78 |
| 1,887,926 | 11/1932 | Fox | 2/78 |
| 2,018,665 | 10/1935 | Flesh | 2/78 |
| 2,018,666 | 10/1935 | Flesh | 2/78 |
| 2,164,683 | 4/1039 | Kessler | 2/77 |
| 2,363,959 | 11/1944 | Hanes | 2/78 |
| 2,377,004 | 5/1945 | Hanes | 2/78 |
| 2,511,977 | 6/1950 | Garrison | 2/77 |
| 3,840,900 | 10/1974 | Cruz | 2/78 |

FOREIGN PATENT DOCUMENTS

| | | | |
|---|---|---|---|
| 1027511 | 5/1953 | France | 2/77 |
| 424896 | 3/1935 | United Kingdom | 2/77 |

*Primary Examiner*—Werner H. Schroeder
*Assistant Examiner*—Gloria Hale
*Attorney, Agent, or Firm*—A. Ray Osburn

[57] ABSTRACT

A combined article of clothing as disclosed, having an upper torso portion suitable for outerwear along with a lower portion adapted to serve as underwear for the midsection of the body. The garment is particularly adaptable for men and boys, and serves to maintain shirt tails and the like neatly tucked into the overlaying trousers, while providing all of the comfort of conventional underwear briefs.

13 Claims, 2 Drawing Sheets

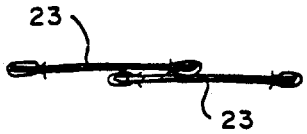
FIG. 4
FIG. 3
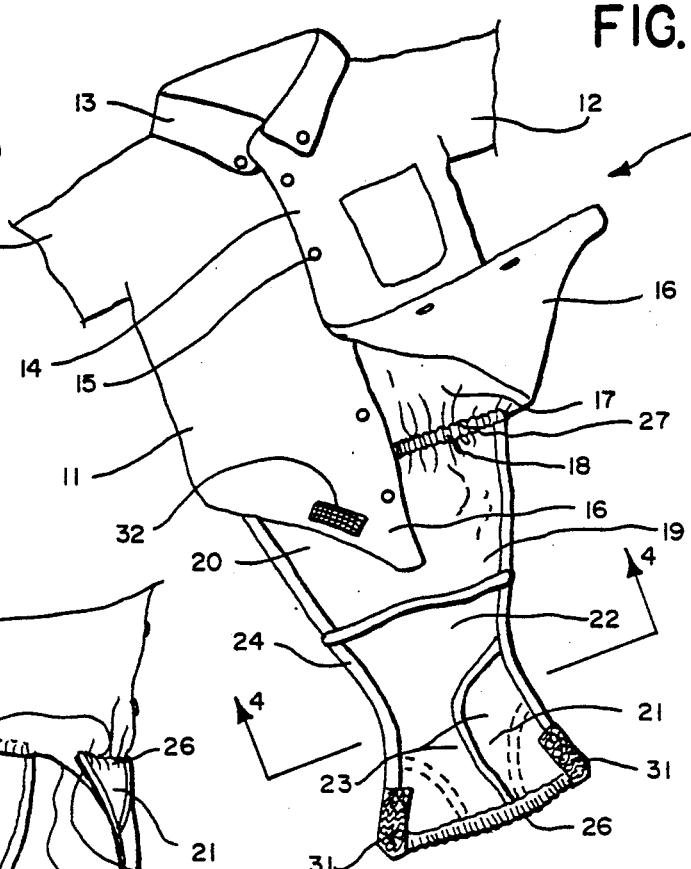
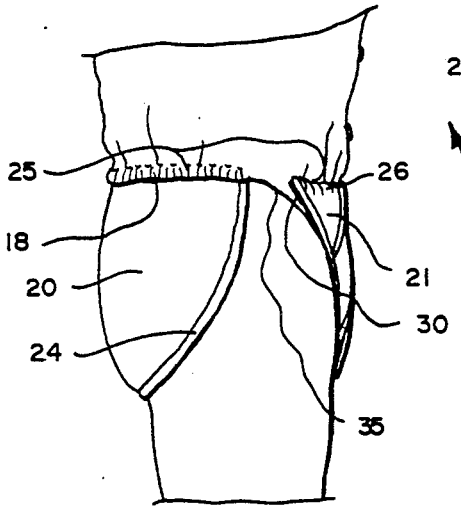
FIG. 5
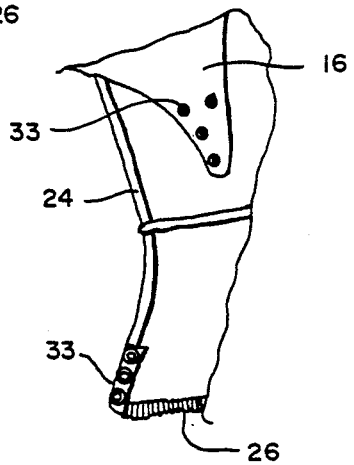
FIG. 6
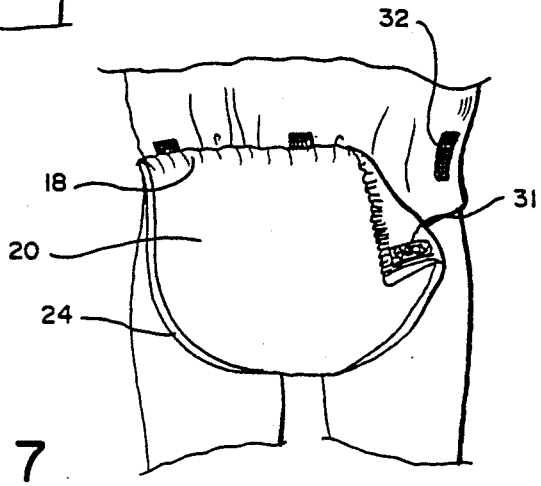
FIG. 7

COMBINED CLOTHING ARTICLE

BACKGROUND OF THE INVENTION

Field

1. The field of the invention is clothing, more particularly clothing articles which combine upper body outerwear and midsection underwear.

2. State of the Art

Conventional apparel includes traditional trunk covering shirts for men and boys and blouses for women and girls, along with separate underwear articles such as briefs and boxer shorts for men and midsection lingerie for women and girls. These upper body items are worn with lower body outerwear such as trousers or slacks for both men and women and skirts for the latter. Shirts and blouses are normally worn neatly tucked into the waist of the lower outside garment. The maintenance of this neat tuck, especially with smaller children, has been an unsolved problem for as long as shirts have been worn, especially for men and boys. A garment, sometimes called a body shirt, has been employed which has a crotch strap extension of the rear tail of a shirt attached releasably by snaps or the like to the front tails of the shirt. U.S. Pat. No. 3,840,900 discloses such a body shirt for men. The fabric of the rear tail of the shirt is shaped to form a seat portion, with a crotch strap sewn at one end to its lowermost extension. The strap is attached at its other end by snaps to the front shirt tails. The fabrics of which shirts are normally constructed are not highly adapted for comfort in the midsection region of the body. Any body movements tending to pull the shirt tails upwardly from the waistline is directly resisted by the tail connecting strap, with attendant uncomfortable stress and chafing in the sensitive crotch region, although soft lining may be applied to alleviate this problem to some extent. Underwear briefs, for example, worn under the strap provide welcome softness, but add unwanted binding and bunching bulk.

The need therefore remains for a comfortable, easily effected, solution to the shirt waist untucking problem.

BRIEF SUMMARY OF THE INVENTION

With the foregoing in mind, the present invention eliminates or substantially alleviates the shortcomings and disadvantages in prior art devices and garments for retaining shirt tails and the like neatly tucked into outerwear at the waist. A unitary garment is provided, combining clothing for both the upper trunk and the midsection of the body. The trunk portion may be constructed of conventional shirt or blouse material, for example, while the midsection is preferably constructed of the soft, comfortably yielding cloth conventionally used for underwear briefs worn in that region of the body. The brief portion is shaped, sized and so attached to the trunk portion as to fit the body very similarly to the fit of conventional briefs. Seat and abdominal portions extend upwardly to join with rear and front waist band sections, which together substantially gird the body at the hips near the waist. Front and rear waist sections of the combined garment are designed to stretch about the body, the cloth of both being accordioned by incorporated elastic material. Most advantageously, the elastic may be sewn, while stretched, to brief and shirt rear waist, which have been previously stitched together. However, the elastic may be first incorporated into the brief rear waist only, which may then be attached to the shirt rear waist permanently or detachably at the option of the designer.

The front shirt tails and the upper front portion of the briefs carry releasable attachment devices, such as hook and loop material or male and female snaps. The fasteners are spaced apart so that the front shirt tails are also accordioned or pleated between the attaching points by the elastic waist of the briefs, as necessary to fit the body. Thus the briefs and shirt portions of the garment share an elastic waist substantially entirely girding the waist of the body. As with conventional briefs, the legs of the wearer may be embraced by elastic edges incorporated into the briefs portion joining the front and rear waist portions. The brief portions are preferably constructed entirely of soft stretchable material, such as the interlock woven cotton commonly used for such garments.

It is therefore the principal object of the invention to provide an entirely comfortable combined upper outergarment and a midsection undergarment, wherein the lower portion of the upper garment is maintained permanently in neat, comfortable tucked position within the trousers, skirt or the like of the wearer.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
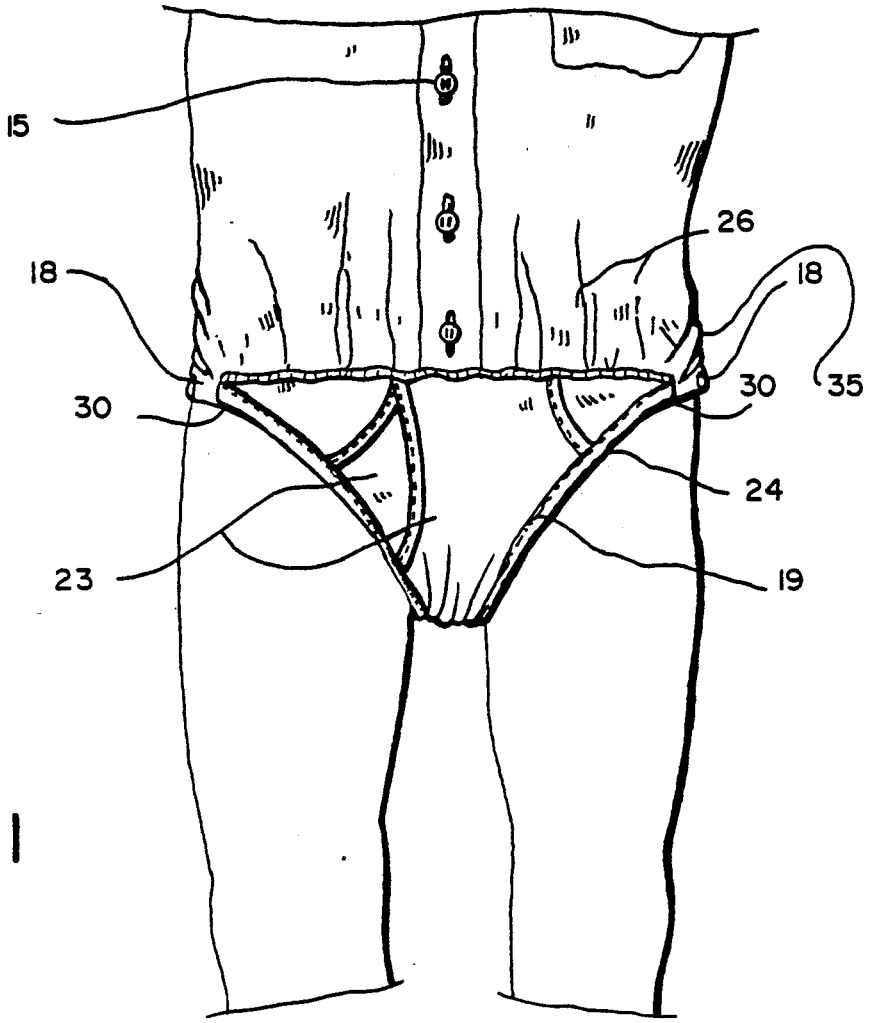
FIG. 1 is a front elevation view of a lower fragment of a combined article of clothing in accordance with the invention, drawn to a reduced scale, FIG. 2 a rear elevation view of the fragment of FIG. 1, drawn to the same scale, FIG. 3 a front perspective view of the combined article of clothing in accordance with the invention, drawn to approximately the same scale as FIG. 1, FIG. 4 a cross sectional view taken along line 4—4 of FIG. 3, drawn to a somewhat larger scale than FIG. 3, FIG. 5 a side elevation view of the fragment of FIG. 1, drawn to approximately the same scale, FIG. 6 a view of a fragment of the article of clothing of FIG. 3, showing an alternative fastening method, drawn to approximately the same scale as FIG. 3, and FIG. 7 a view of a fragment of the rear waist portion of the article of FIG. 3, fastened by an alternative fastening method, drawn to approximately the same scale as FIG. 3.
Figure 2:
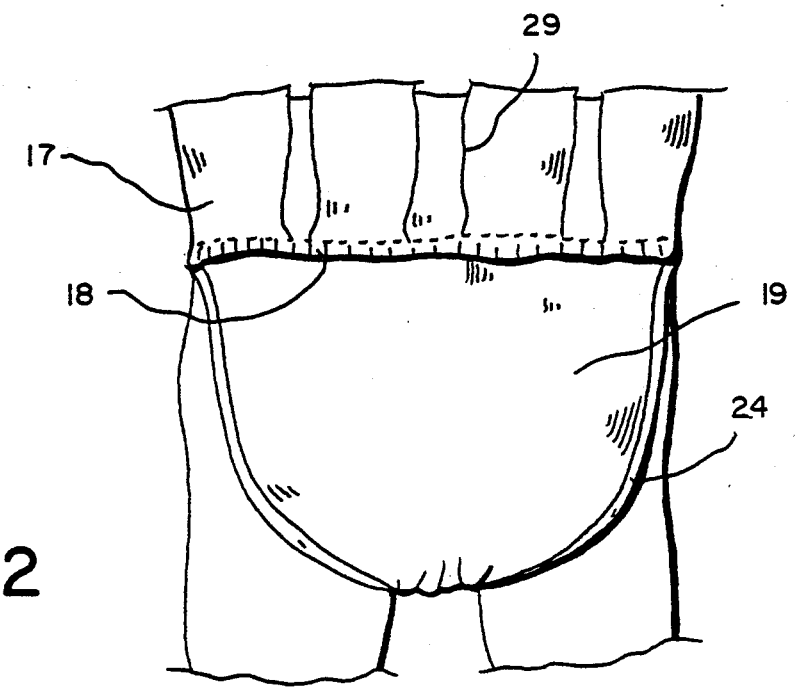

A combination shirt and briefs 10 in accordance with the invention is illustrated being worn by a man or boy in FIGS. 1, 2 and 5. The shirt 11 clothes the upper trunk and shoulders conventionally, comprising sleeves 12, collar 13 and a split front 14 secured together by buttons 15 and terminating in front "tails" 16. (FIG. 3) The back 17 of shirt 11, however, does not have a conventional tail, but terminates where joined with the back waist portion 18 of the briefs 19. Briefs 19 are of generally conventional construction, having a buttock covering rear seat 20 and a front abdomen portion 21 connected by a crotch member 22, all made of comfortably soft material such as cotton in a comfortable stretchable weave such as interlock. Abdomen 21 is, for men and boys, constructed with overlaps 23, which can be separated to form an opening. (FIG. 4) Preferably, seat, crotch and abdomen portions are edged by elastic bands 24 comfortably gripping the body. Briefs 19 also have an uppermost elastic waist 25, similar to the waists of conventional briefs, but provided in rear and front sections 18 and 26 respectively. Both waist sections are secured to the shirt 11. Front waist 26 is detachably connected to shirt 11, while rear waist 18 is permanently connected in the embodiment of FIGS. 1–6.

Rear brief waist 18 is stitched to the lower edge 27 of shirt back 17, along with an elastic band (not shown) in stretched condition. Shirt bottom 27 forms into pleats 29 as the elastic contracts upon release. Brief waist 18 and shirt bottom 27 act elastically as a unit.

Front brief waist 26 is connected at each of its ends 30 to one of the front shirt tails 16, as by elongate hook and loop swatches 31 and 32 carried respectively by front brief waist 26 and tails 16. Front waist 26 and rear waist 18 are generally at approximately the same level, although the former may be adjusted to somewhat lower or higher positions to accommodate differing torso lengths. Swatches 31 and 32 could be replaced by male/female snap assemblies 33, for example. (FIG. 6) The loop swatches 32 on tails 16 are placed well to the sides 34 of shirt 11, so that front and rear brief waists 26 and 18 together elastically gird the body substantially all around, interrupted only by short sections 35 at each side of shirt 11. Shirt tails 16 are formed into pleats 36 between swatches 32, as necessary to fit the body.

The brief back waist portion 18 need not necessarily be permanently secured along the lower edge 27 of the shirt back 17, although this is highly convenient. For example, elastic may first be incorporated into brief rear waist 18 separately of shirt bottom 27. Then, as with front waist 26, hook and loop swatches 37 could be provided. (FIG. 7) The combination garment 10 would in either event be donned with the rear waist 18 secured, followed by attachment of the front waist 28.

Briefs 19 act in all respects as comfortable conventional briefs while retaining the shirt neatly tucked into the wearer's trousers, pleated uniformly and attractively both front and rear.

The combination shirt and briefs 10 is illustrated as adapted for the use of men or boys. However, it could, even as illustrated, be utilized by women and girls. Further, shirt 11 could be replaced with a female blouse, and briefs 19 by an appropriate item of female lingerie suitably adapted.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. A combined article of clothing, comprising:

an upper garment to clothe the torso of the body, having a rear portion, a neck portion, and a front portion;

a lower garment to clothe the buttocks, crotch and abdomen of the body; wherein the buttock clothing portion of the lower garment is secured at its uppermost extension to the lower extremity of the rear portion of the upper garment, and the uppermost extension of its abdomen clothing portion is releasably secured to the lowermost extremity of the front portion of the upper garment, the upper garment being constructed of material suitable for outerwear and the lower garment of material suitable for underwear;

the buttock portion and the rear portion of the upper garment are permanently joined along with elastic material to form a horizontal rear waist portion which elastically adjusts to the body of a wearer;

the abdomen clothing portion terminates at its uppermost edge in a horizontal, elastic, front waist portion; and the elastic front waist portion is releasably secured to the lowermost part of the front portion of the upper garment in a manner permitting the front waist portion and the front portion of the upper garment to elastically adjust together to the body of the wearer; so that the body of the wearer is elastically girded substantially all around.

2. The combined article of clothing of claim 1, wherein:

the elastic rear waist portion is fastened together by sewing; and the elastic front waist portion is secured to the upper garment by hook and loop swatches spaced apart so as to allow said waist portion to elastically adjust to the body unimpeded by the upper garment.

3. The combined article of clothing of claim 1, wherein:

the elastic rear waist portion is fastened together by sewing; and the elastic front waist portion is secured to the upper garment by male and female snap means spaced apart to allow said waist portion to elastically adjust to the body unimpeded by the upper garment.

4. The combined article of clothing of claim 2, wherein:

the hook and loop swatches are sized and located to permit selective attachment of the elastic front waist portion to correspond to differing torso lengths of wearers of the combined article of clothing.

5. The combined article of clothing of claim 3, wherein:

the male and female components of the snap means are provided in locations and numbers to permit selective attachment of the elastic front waist portion to correspond to differing torso lengths of wearers of the combined article of clothing.

6. The combined article of clothing of claim 1, wherein:

the front portion of the upper garment is vertically separated centrally from the neck to the bottom thereof, forming two lowermost tails; and the elastic front waist portion is secured at each of its ends to the corresponding one of the two front tails.

7. The combined article of clothing of claim 1, wherein:

the lower garment is constructed of interlock woven cotton fabric or the like conventionally employed for briefs for men and boys.

8. The combined article of clothing of claim 7, wherein:

the lower garment is constructed of interlock woven cotton fabric conventionally employed for briefs for men and boys.

9. The combined article of clothing of claim 3, wherein:

the lower garment is constructed of interlock woven cotton fabric conventionally employed for briefs for men and boys.

10. The combined article of clothing of claim 2, wherein:

the front portion of the upper garment is vertically separated centrally from the neck to the bottom thereof, forming two lowermost tails; and the elastic front waist portion is secured at each of its ends to the corresponding one of the two front tails.

11. A combined article of clothing, comprising:

an upper garment to clothe the torso of the body, having a rear portion, a neck portion, and a front portion;

a lower garment to clothe the buttocks, crotch and abdomen of the body; wherein the buttock clothing portion of the lower garment is secured at its uppermost extension to the lower extremity of the rear portion of the upper garment, and the uppermost extension of its abdomen clothing portion is releasably secured to the lowermost extremity of the front portion of the upper garment, the upper garment being constructed of material suitable for outerwear and the lower garment of material suitable for underwear;

the buttock portion terminates at its uppermost extension in an elastic rear waist portion, said waist portion being secured to the lowermost extremity of the rear portion of the upper garment in a manner permitting it to elastically adjust to the body of a wearer unimpeded by the upper garment;

the abdomen portion terminates at its uppermost edge in a horizontal, elastic, front waist portion; and the elastic front waist portion is releasably secured to the lowermost part of the front portion of the upper garment in a manner permitting the front waist portion to elastically adjust to the body of the wearer unimpeded by the upper garment; so that the body of the wearer is elastically girded substantially all around.

12. The combined article of clothing of claim 11, wherein:

the rear waist portion is permanently secured to the rear portion of the upper garment.

13. The combined article of clothing of claim 11, wherein:

the rear waist portion is releasably secured to the rear portion of the upper garment.

* * * * *